US008584310B2

(12) United States Patent
Beers et al.

(10) Patent No.: US 8,584,310 B2
(45) Date of Patent: Nov. 19, 2013

(54) VACUUM ELECTRONIC POWER TOOL SENSE

(75) Inventors: David R. Beers, Dallastown, PA (US); Kathy E. DiPasquale, Baltimore, MD (US); Spencer G. Maid, Harland, WI (US)

(73) Assignee: Black & Decker Inc., Newark, DE (US)

( * ) Notice: Subject to any disclaimer, the term of this patent is extended or adjusted under 35 U.S.C. 154(b) by 549 days.

(21) Appl. No.: 12/899,030

(22) Filed: Oct. 6, 2010

(65) Prior Publication Data

US 2011/0016656 A1 Jan. 27, 2011

Related U.S. Application Data

(62) Division of application No. 11/870,939, filed on Oct. 11, 2007, now Pat. No. 8,015,657.

(60) Provisional application No. 60/900,351, filed on Feb. 9, 2007.

(51) Int. Cl.
*A47L 9/28* (2006.01)

(52) U.S. Cl.
USPC ..... 15/339; 15/327.2; 174/66; 174/67; 439/372; 439/373; 439/374; 220/241

(58) Field of Classification Search
USPC ..... 439/372, 373, 374; 15/339, 327.2; 220/241; 174/66, 67
IPC ..... A47I 9/28
See application file for complete search history.

(56) References Cited

U.S. PATENT DOCUMENTS

| | | | | |
|---|---|---|---|---|
| 1,864,622 | A | 6/1932 | Sutherland | |
| 2,522,882 | A | 9/1950 | Lofgren | |
| 2,570,307 | A | 10/1951 | Bell et al. | |
| 3,236,032 | A | 2/1966 | Yasukawa et al. | |
| 3,320,726 | A | 5/1967 | Black, Jr. | |
| 3,428,936 | A * | 2/1969 | Arnao, Jr. | 439/144 |
| 3,591,888 | A | 7/1971 | Takeda et al. | |
| 3,656,083 | A | 4/1972 | Brook | |
| 3,695,006 | A | 10/1972 | Valbona et al. | |
| 3,708,962 | A | 1/1973 | Deguchi et al. | |
| 3,936,904 | A | 2/1976 | Bashark | |
| 3,955,870 | A * | 5/1976 | Wasserman | 439/144 |

(Continued)

FOREIGN PATENT DOCUMENTS

| | | | |
|---|---|---|---|
| DE | 29717282 | U1 | 11/1997 |
| DE | 10102061 | C1 | 6/2002 |

(Continued)

OTHER PUBLICATIONS

Talema AC1030, 30 Amp Current Transformer; http://www.talema-nuvotem.com; CT's\AC1030 05-00 (1 page).

*Primary Examiner* — David Redding
(74) *Attorney, Agent, or Firm* — Harness, Dickey & Pierce, P.L.C.

(57) ABSTRACT

A vacuum electronic power tool sense system senses the operation of a power tool that is plugged into an onboard power outlet and the vacuum source is automatically operated to facilitate user clean-up of debris generated by use of the power tool. A delay period can be utilized to maintain the vacuum source is an on state for a predetermined period of time after the power tool is turned off.

3 Claims, 6 Drawing Sheets

(56) References Cited

U.S. PATENT DOCUMENTS

| | | | | | |
|---|---|---|---|---|---|
| 4,021,879 | A | | 5/1977 | Brigham | |
| 4,070,078 | A | | 1/1978 | Chrones | |
| 4,266,257 | A | | 5/1981 | Rudich, Jr. | |
| 4,302,624 | A | | 11/1981 | Newman | |
| 4,357,729 | A | | 11/1982 | Vander Molen et al. | |
| 4,398,316 | A | | 8/1983 | Scott et al. | |
| 4,611,365 | A | | 9/1986 | Komatsu et al. | |
| 4,628,440 | A | | 12/1986 | Thompson et al. | |
| 4,654,924 | A | | 4/1987 | Getz et al. | |
| 4,825,140 | A | | 4/1989 | St. Louis | |
| 5,045,640 | A | * | 9/1991 | Riceman | 174/67 |
| 5,072,484 | A | | 12/1991 | Edlund | |
| 5,099,157 | A | | 3/1992 | Meyer | |
| 5,120,983 | A | | 6/1992 | Samann | |
| 5,256,906 | A | | 10/1993 | Tsuge et al. | |
| 5,265,305 | A | | 11/1993 | Kraft et al. | |
| 5,276,939 | A | | 1/1994 | Uenishi | |
| 5,404,612 | A | | 4/1995 | Ishikawa | |
| 5,541,457 | A | | 7/1996 | Morrow | |
| 5,554,917 | A | | 9/1996 | Kurz et al. | |
| 5,596,181 | A | | 1/1997 | Bach et al. | |
| 5,747,973 | A | | 5/1998 | Robitaille et al. | |
| 5,955,791 | A | | 9/1999 | Irlander | |
| 5,989,052 | A | * | 11/1999 | Fields et al. | 439/373 |
| 6,008,608 | A | | 12/1999 | Holsten et al. | |
| 6,026,539 | A | | 2/2000 | Mouw et al. | |
| 6,029,309 | A | | 2/2000 | Imamura et al. | |
| 6,044,519 | A | | 4/2000 | Hendrix | |
| 6,131,236 | A | | 10/2000 | Roth et al. | |
| 6,222,285 | B1 | | 4/2001 | Haley et al. | |
| 6,457,843 | B1 | * | 10/2002 | Kester et al. | 362/276 |
| 6,526,622 | B2 | | 3/2003 | Conrad | |
| 6,569,218 | B2 | | 5/2003 | Dudley | |
| 6,625,845 | B2 | | 9/2003 | Matsumoto et al. | |
| 6,758,874 | B1 | | 7/2004 | Hunter, Jr. | |
| 6,946,967 | B2 | | 9/2005 | Klaus et al. | |
| 7,097,474 | B1 | * | 8/2006 | Naylor | 439/135 |
| 7,296,323 | B2 | * | 11/2007 | Hayama et al. | 15/339 |
| 2004/0177471 | A1 | | 9/2004 | Jung et al. | |
| 2004/0187253 | A1 | | 9/2004 | Jin et al. | |
| 2005/0091784 | A1 | | 5/2005 | Bone | |
| 2005/0120510 | A1 | | 6/2005 | Weber | |
| 2005/0132528 | A1 | | 6/2005 | Yau | |
| 2005/0198766 | A1 | | 9/2005 | Nam et al. | |
| 2005/0217067 | A1 | | 10/2005 | Rew et al. | |
| 2009/0241283 | A1 | | 10/2009 | Loveless et al. | |

FOREIGN PATENT DOCUMENTS

| | | | |
|---|---|---|---|
| DE | 20218996 | U1 | 3/2003 |
| EP | 0155502 | | 9/1985 |
| EP | 0411855 | A2 | 2/1991 |
| EP | 1083652 | A2 | 3/2001 |
| WO | 02058195 | A1 | 7/2002 |

* cited by examiner

VACUUM ELECTRONIC POWER TOOL SENSE

CROSS-REFERENCE TO RELATED APPLICATIONS

This application is a divisional of U.S. patent application Ser. No. 11/870,939, filed Oct. 7, 2007, which claims the benefit of U.S. Provisional Application No. 60/900,351, filed on Feb. 9, 2007, the disclosure of which is incorporated herein by reference.

FIELD

The present disclosure relates to vacuum electronics, and more particularly to an electronic power tool sense system for a vacuum.

BACKGROUND

The statements in this section merely provide background information related to the present disclosure and may not constitute prior art.

Conventional industrial shop vacuums are employed for both wet and dry usage. However, the electronics for conventional industrial shop vacuums can be primitive in design.

Conventional vacuums may include a container and a cover that closes the container. The cover may support a vacuum motor with a power cord. The power cord may include a power plug that may be connected to a power source. When powered up, the vacuum motor may rotate a suction fan, thereby drawing air from the container. A flexible hose may be mounted on an inlet to the vacuum for drawing debris (including solids, liquids, and gases) into the container.

Conventional vacuums may also include an onboard power outlet that may be electrically connected to the power cord of the vacuum. The onboard power outlet may receive a power plug of a power tool. Accordingly, a user may plug the power plug of the vacuum motor into a power outlet in a wall (or some other power source), and plug the power plug of the power tool into the onboard power outlet of the vacuum. In this way, the vacuum motor and the power tool may be driven with only a single power cord (i.e., the power cord of the vacuum) being physically connected to a power source.

While the conventional onboard power outlets are generally thought to provide acceptable performance, they are not without shortcomings. For example, the power plug of the power tool may be inadvertently unplugged from the onboard power outlet of the vacuum.

SUMMARY

The present disclosure provides a vacuum electronic power tool sense system for sensing the operation of a power tool that is plugged into a power outlet disposed on the housing. The detection of operation of a power tool plugged into the power outlet disposed on the housing causes the controller to also operate a vacuum source of the vacuum to provide simultaneous operation of the power tool and vacuum in order to facilitate user clean-up of messes generated by use of the power tool. If the power tool is turned off, the vacuum source can be further operated for a predetermined delay period to allow the vacuum to clean up additional debris created by operation of the power tool.

According to an example, non-limiting embodiment, a vacuum may also include a housing supporting the power outlet. A door may be mounted for movement on the housing between an opened position and a closed position in which the door is superposed above the power outlet. The door may include a notch to receive a power cord of a power tool and may prevent the plug of the power cord from being inadvertently pulled out of the power outlet.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
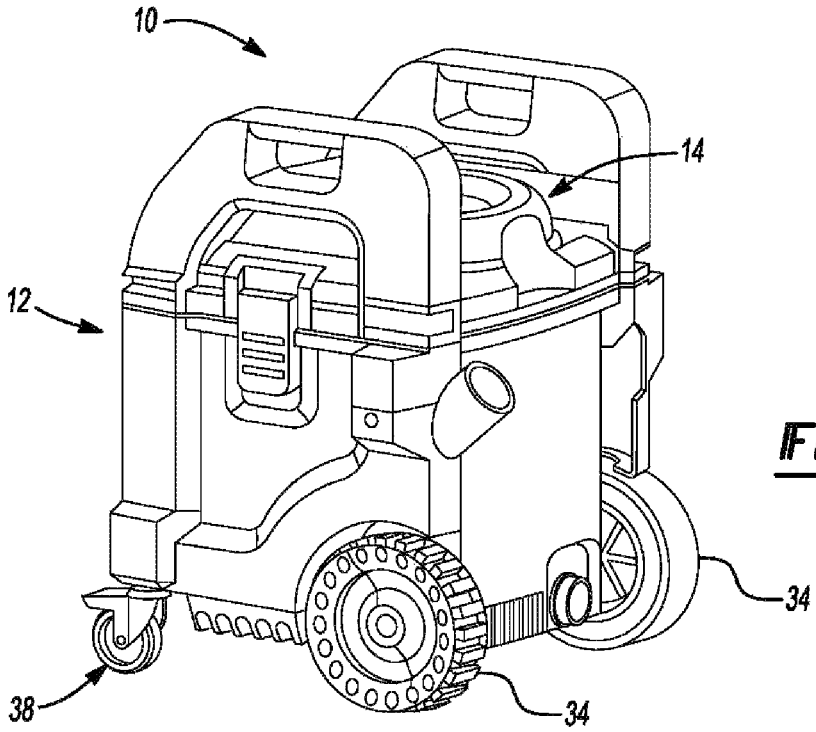
FIG. 1 is a perspective view of an example industrial shop vacuum according to the principles of the present disclosure.

The following description is merely exemplary in nature and is not intended to limit the present disclosure, application, or uses. It should be understood that throughout the drawings, corresponding reference numerals indicate like or corresponding parts and features.

Figure 2:
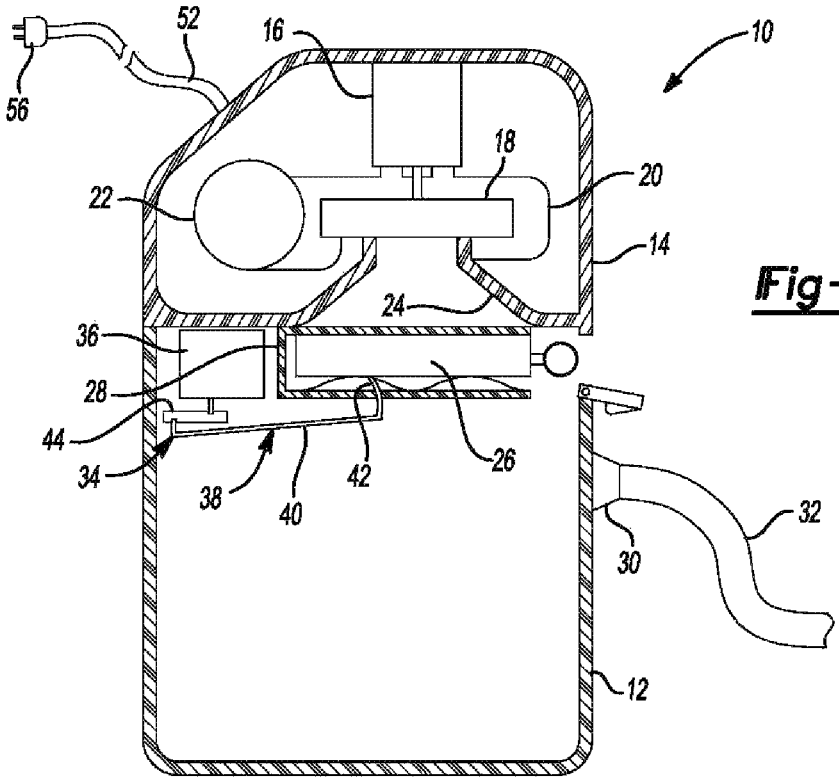
FIG. 2 is a schematic diagram of an example industrial shop vacuum according to the principles of the present disclosure.

With reference to FIGS. 1 and 2, an example vacuum 10, according to the principles of the present disclosure, will now be described. The vacuum 10 may include a canister 12 and a vacuum head 14 that closes the canister 12. The vacuum head may support a drive motor 16. The drive motor 16 may support a suction fan 18, which may be provided in a fan chamber 20 of the vacuum head 14. The fan chamber 20 may be in fluid communication with an exhaust port 22 and an intake port 24. The intake port 24 may be covered by a filter assembly 26 situated in a filter housing 28 of a vacuum head 14.

A motor 16, when powered up, may rotate the suction fan 18 to draw air into the suction inlet opening 30 and through the canister 12, through the filter assembly 26, through the intake port 24 and into the fan chamber 20. The suction fan 18 may push the air in the fan chamber 20 through the exhaust port 22 and out of the vacuum 10. A hose 32 can be attached to the inlet opening 30.

The canister 12 can be supported by wheels 34. The wheels 34 can include caster wheels, or the wheels can alternatively be supported by an axle.

A filter cleaning device 34 is provided including a filter cleaning motor 36 drivingly connected to a filter cleaning mechanism 38. The filter cleaning mechanism 38 can take many forms, and can include an eccentrically driven arm 40 having fingers 42 engaging the filter 26. The filter cleaning device 34 can be driven to traverse across the filter 26 to cause debris that is stuck to the filter to be loosened up and fall into the canister 12. The arm 40 is connected to an eccentric drive member 44 which is connected to motor 36 and, when rotated, causes the arm 40 and fingers 42 to traverse across the surface of the filter 26.

Figure 3:
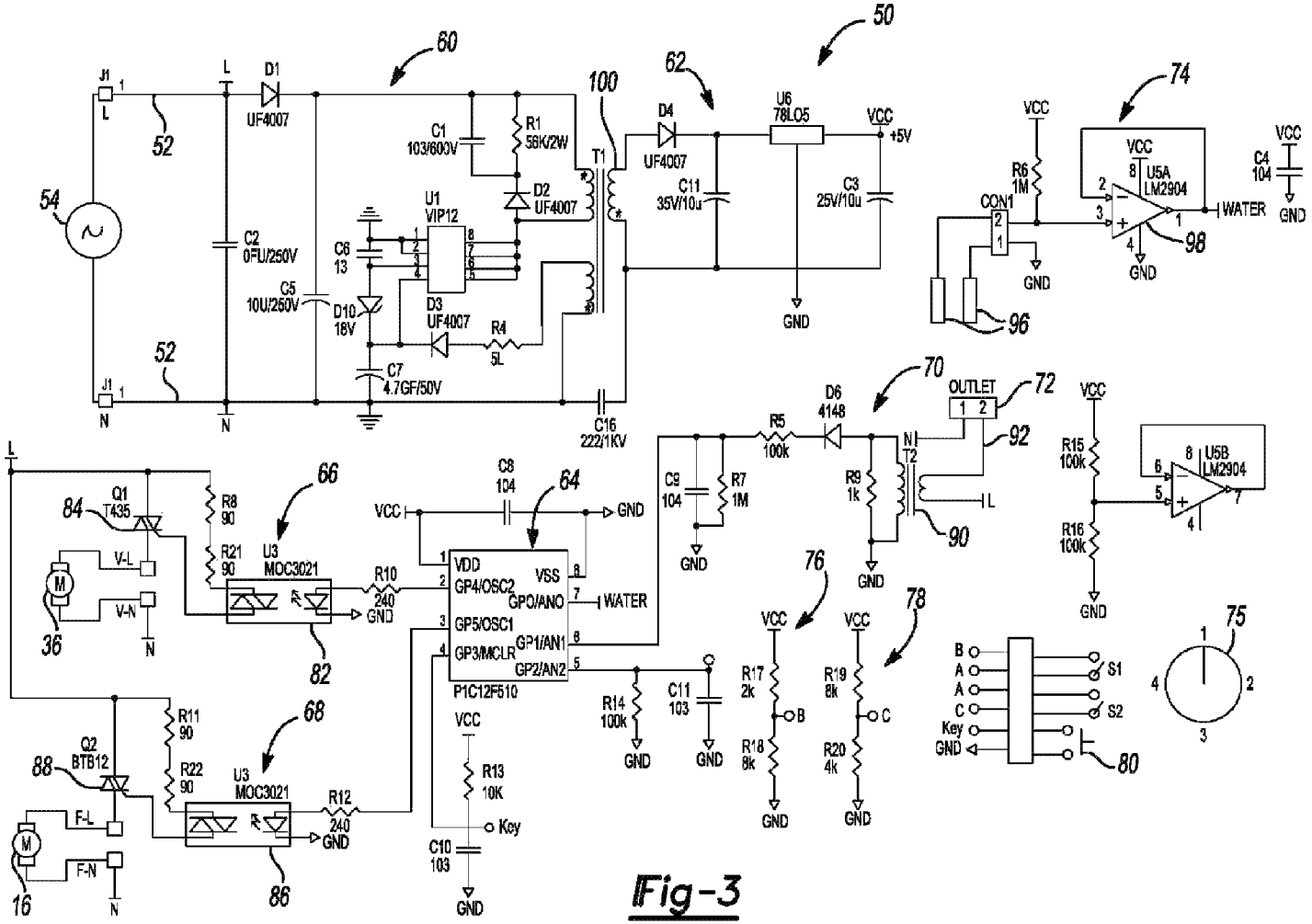
FIG. 3 is a schematic circuit diagram for the electronic controls according to the principles of the present disclosure.

With reference to FIG. 3, a schematic diagram of the electronics 50 utilized to operate the vacuum 10 will now be described. The electronics 50 generally include a power cord 52 extending from the vacuum and adapted for connection with an AC power source 54. In particular, the power cord 52 can include a plug 56 (FIG. 2) having a two-prong or three-prong connection as is known in the art, as is shown in FIG. 2. The power cord 52 is connected to a power source circuit 60. An electrical isolation circuit 62 is provided in communication with the power source circuit 60 for providing a low voltage output VCC, as will be described in greater detail herein. A microcontroller 64 is provided in communication with the electrical isolation circuit 62 for receiving a low voltage supply VCC therefrom. The microcontroller 64 provides control signals to a filter cleaning circuit 66 and a vacuum circuit 68.

A power tool sense circuit 70 is provided in communication with the microcontroller 64 for providing a signal to the microcontroller 64 regarding operation of a power tool that is plugged into an outlet 72 that can be disposed on the power tool 10. The outlet 72 can be connected to the power cord 52 as indicated by nodes L, N. A water sense circuit 74 is provided in communication with the microcontroller 64 for providing a signal ("water") to the microcontroller 64 that the water level in the canister 12 has reached a predetermined level for deactivating the vacuum source in order to prevent water from being drawn into the vacuum filter 26.

A multi position switch such as four position rotary switch 75 can be utilized for providing different activation states of a first micro-switch S1 and a second micro-switch S2 for controlling operation of the vacuum motor 16. The switches S1 and S2 are connected to connectors A, B and A, C, respectively, wherein connectors B and C are connected to ratio circuits 76, 78, respectively. Connector A provides an input signal to the microcontroller 64 indicative of the activation state of micro-switch S1 and micro-switch S2 in order to provide four modes of operation utilizing the two micro-switches S1 and S2 while providing just a single input into the microcontroller 64. Table 1 provides a list of the mode selection possibilities of the four position user switch 75 with micro-switches S1 and S2 in the different activation states.

TABLE 1

| User Switch Position | S1 | S2 | Microcontroller Input VCC Ratio |
|---|---|---|---|
| 1 | 0 | 0 | 0 * VCC |
| 2 | 0 | 1 | (1/3) * VCC |
| 3 | 1 | 0 | (4/5) * VCC |
| 4 | 1 | 1 | (5/8) * VCC |

With each of the four possible activation states of micro-switches S1 and S2, the ratio circuit 76, 78 provide different ratio input signals as a function of the low voltage supply VCC. In particular, by way of example as shown in Table 1, when both switch S1 and switch S2 are open, a zero ratio VCC signal is received by the microcontroller 64. When switch S1 is open and switch S2 is closed, a 1/3 ratio VCC signal is provided. When the switch S1 is closed and switch S2 is open, a 4/5 VCC ratio signal is provided, and when both switches S1 and S2 are closed, a 5/8 VCC ratio signal is provided to the microcontroller 64. The ratios are determined by the resistance levels of resistors R17-R20 provided in the ratio circuits 76, 78. Ratios, number of switches, and number of resistors can vary for inputs other than 4. With these four input signals provided at a single microcontroller input, four user selectable modes are provided, thereby simplifying the microcontroller input and reducing the cost of the microcontroller.

The four user selectable modes can include position (1) vacuum off, power outlet is off, auto filter clean is off and filter clean push button is off; position (2) vacuum on, power outlet is off, auto filter clean is off and filter clean push button is on; position (3) vacuum on, power outlet off, auto filter clean is on and filter clean push button is on; and position (4) (auto mode) vacuum is controlled by outlet, auto filter clean is on and filter clean push button is on. These operation modes are exemplary and different modes can be enabled and disabled by the microcontroller 64. Further, more or fewer switch positions can also be employed as well as more micro-switches and ratio circuits can also be utilized that are activated by the user switch for providing even further distinct operation modes.

A filter clean switch 80 is also provided for providing a signal to the microcontroller 64 for operating the filter cleaning device via activation of the filter cleaning circuit 66. The filter cleaning circuit 66 includes an opto-coupler 82 which can be activated by a low voltage signal from the microcontroller 64. The opto-coupler 82 provides an activation signal to a triac 84. When the gate of the triac 84 is held active, the triac 84 conducts electricity to the filter cleaning motor 36 for activating the filter cleaning device 34. The opto-coupler 82 requires only a low power input for holding the triac 84 active. Additionally, the triac may be held continuously active for a time period then turned inactive, or pulsed active/inactive for a timer period, or the triac may be replaced by an SCR and driven with DC in a similar manner just described.

The auto filter clean mode will turn off the vacuum for a brief period while the filter cleaning device 34 moves across the filter pleats. This can occur at predetermined intervals while the vacuum is operated continuously and every time the vacuum is turned off. The filter clean push button mode, when activated by user switch 75 and be pressing the push button 80, will cause the vacuum to turn off for a brief period while the filter cleaning device 34 is operated to move across the filter pleats.

The microcontroller 64 can also provide a control signal to the vacuum circuit 68. The vacuum circuit 68 is provided with an opto-coupler 86 which receives a low voltage signal from the micro-controller 64. The opto-coupler 86 can provide an activation voltage to a triac 88 which is held active by the voltage supplied by the opto-coupler 86 to provide electricity to the vacuum motor 16. The opto-coupler 86 requires only a low power input for holding the triac 88 active.

The power tool sense circuit 70 is provided with a current transformer 90 that senses current passing through an electrical connection to the power outlet 72 that supplies power to a power tool that can be plugged into the power outlet 72. The current transformer 90 provides a signal to the microcontroller 64 indicative to the activation state of a power tool plugged into the outlet 72. In response to the power tool sense circuit 70, the microcontroller 64 can automatically activate the vacuum motor 16 for driving the vacuum source. Thus, when a power tool is plugged into the outlet 72 and is activated by a user, the vacuum motor 16 can be activated to assist in vacuuming debris that is created by the use of the power tool. The microcontroller 64 can delay deactivation of the vacuum motor 16 after the power tool is deactivated, to allow for the vacuum 10 to collect debris for a predetermined period of time after the power tool is deactivated.

The water sense circuit 74 includes a pair of water sense probes 96 disposed within the canister 12 of the vacuum 10. Probes 96 can be connected to vacuum head 14 and can be suspended within the canister 12 below the level of the filter 26. A buffer device 98 buffers the high impedance water sense input. The microcontroller on its own is unreliable in measuring the high impedance water sense input. The output of the buffer device or amplifier 98 goes to an analog input to the microcontroller 64. The microcontroller software determines the analog level to detect water sense. The water sense probes 96 can be brass probes mounted in the vacuum's canister 12. Water contacting between the probes will be detected by the water sense circuit 74 as a lower impedance.

The electrical isolation circuit 62 is provided to eliminate shock hazard. Three components provide isolation including the power supply transformer 100 as well as the current transformer 90 and the opto-couplers 82, 86. The power supply transformer 100 provides a reduced voltage output from the power source 54. By way of example, a five volt reduced power supply VCC can be provided by the electrical isolation circuit 62 from the AC line voltage source 54. The circuit 60 previous to the transformer is the control circuit for the switching supply. The transformer provides isolation and is part of the switching supply. The five volt regulator takes the isolated control circuit output and reduces it to +5V regulated. The low voltage power supply VCC is utilized by the microcontroller 64 for providing signals to the opto-couplers 82, 86 of the filter cleaning circuit 66 and vacuum circuit 68 as well as supplying power to the water sense circuit 74. Furthermore, the ratio switch circuits 76, 78 are supplied with the low voltage VCC power supply.

Figure 4:
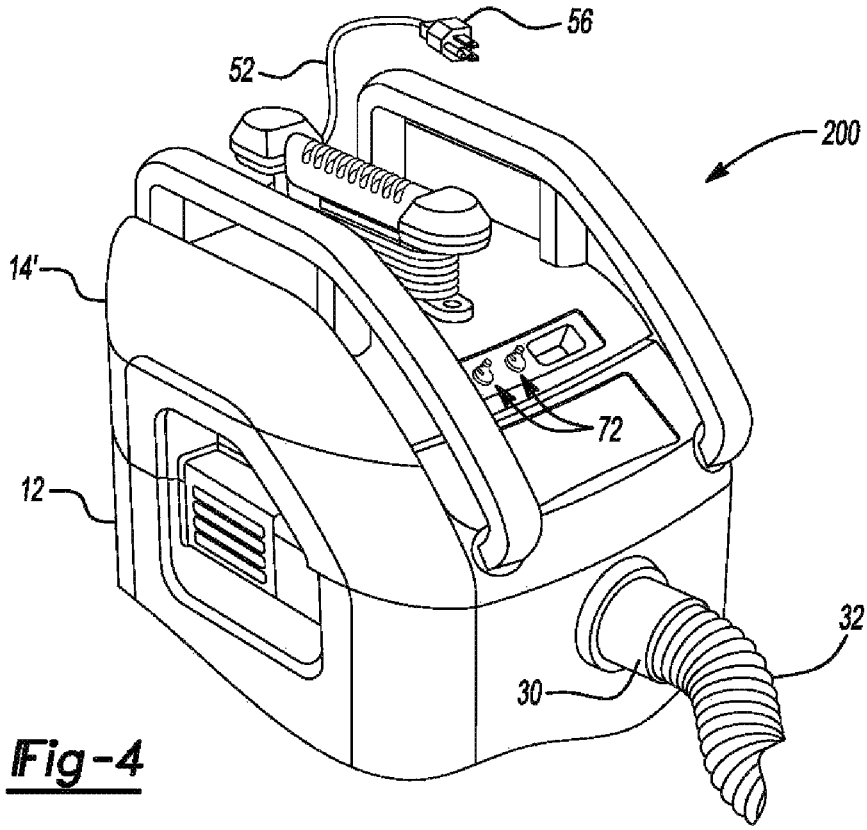
FIG. 4 is a perspective view of an alternative vacuum according to the principles of the present disclosure.

With reference to FIG. 4, an example vacuum 200 may include a canister 12 and a head 14' that closes the canister 12. The head 14' may support a vacuum motor (not shown) with a power cord 52. The power cord 52 may include a power plug 56 that may be connected to a power source. When powered up, the vacuum motor may rotate a suction fan (not shown), thereby drawing air from the canister 12. A flexible hose 32 may be mounted on an inlet 30 to the vacuum for drawing debris (including solids, liquids, and gases) into the canister 12.

The vacuum 200 may also include an onboard power outlet 72 that may be electrically connected to the power cord 52 of the vacuum 200. The onboard power outlet 72 may receive a power plug of a power tool. Accordingly, a user may plug the power plug 56 of the vacuum motor into a power outlet in a wall (or some other power source), and plug the power plug of the power tool into the onboard power outlet 72 of the vacuum 200. In this way, the vacuum motor and the power tool may be driven with only a single power cord (i.e., the power cord 52 of the vacuum 200) being physically connected to a power source 54.

In this example embodiment, the onboard power outlet 72 may be provided on the head 14'. In alternative embodiments, the onboard power outlet 72 may be provided on the canister 12 (or at some other location on the vacuum 200). In this example embodiment, the vacuum 200 may include two onboard power outlets 72. Alternative embodiments may implement more or less than two onboard power outlets 72.

Figure 5:
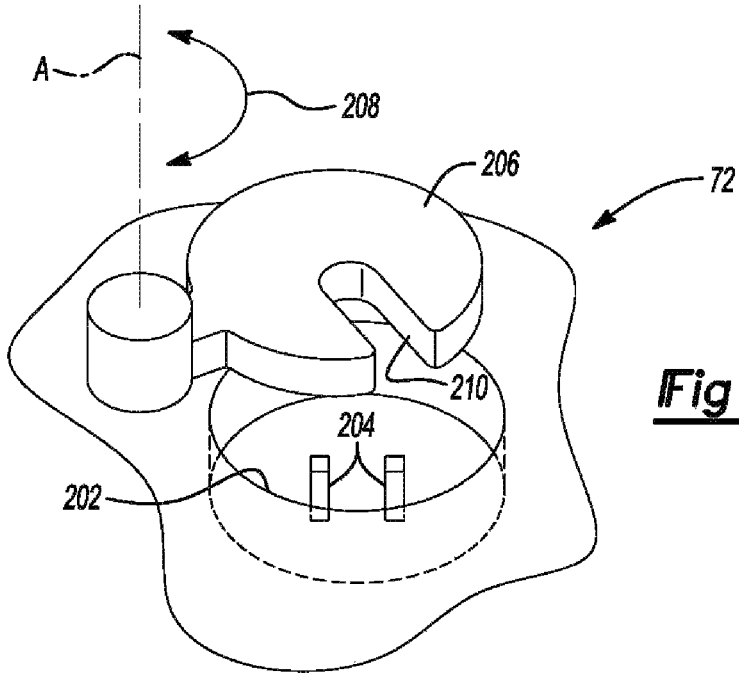
FIG. 5 is a perspective view of an outlet cover according to the principles of the present disclosure.

Turning to FIG. 5, the onboard power outlet 72 may be mounted in a recess 202 of the head 14'. Electrical contacts 204 of the onboard power outlet 72 may be mounted on the bottom of the recess 202. A door 206 may be mounted on the head 14' for pivot action (in the direction of arrow 208) between an opened position (as shown) and a closed position in which the door 206 may cover the recess 202. The door 206 may pivot about an axis A. In this embodiment, the outlet cover or door 206 pivots in a plane parallel with a surface of the housing that surrounds the power outlet 204. By way of example only, a mounting pin (not shown) may be fixed to the door 206 and can be snap fitted into (and rotatable relative to) the head 14'.

The door 206 may include a notch 210. In this example embodiment, the notch 210 may have a "U" shape. It will be readily apparent that notches having numerous and varied shapes (other than a "U" shape) may be suitably implemented. By way of example only, the notch may have a curved shape, a tapered shape or a squared "U" shape. The notch 210 may be of sufficient size to accommodate a power cord of a power tool, but of insufficient size to allow passage of a power plug of the power tool. Example functionality of the door 206 will be appreciated with reference to FIG. 6, which schematically illustrates a power tool 212 having a power cord 214 and power plug 216.

Figure 6:
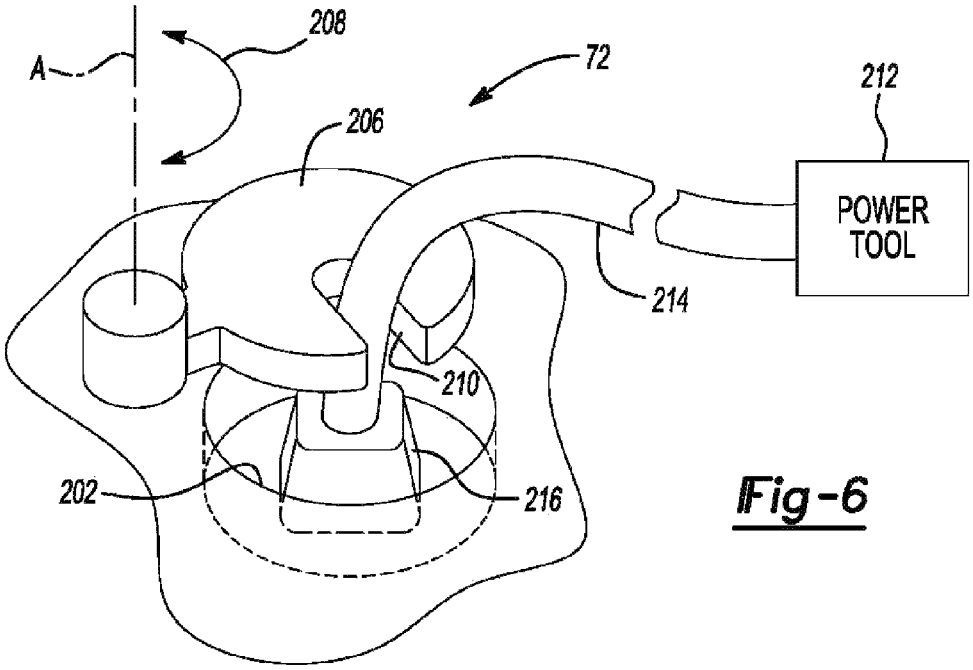
FIG. 6 is a perspective view of the outlet cover of FIG. 5 with a power tool plugged therein.

With the door 206 in the opened position (as shown in FIG. 6), an operator may insert the power plug 216 of the power tool 212 into the recess 202 so that the power plug 210 becomes electrically connected to the contacts 204 of the onboard power outlet 72. The operator may then pivot the door 206 (clockwise in FIG. 6) to the closed position. During this pivot movement, the power cord 214 may enter into the notch 210. In this way, the door 206 may retain the power plug 216 of the power tool 212 in the recess 202, and resist forces tending to pull the power plug 206 out of the onboard power outlet 72. The operator may pivot the door 206 (counter clockwise in FIG. 6) to the opened position to remove the power plug 216 from the onboard power outlet 72.

Example Modifications

Figure 7:
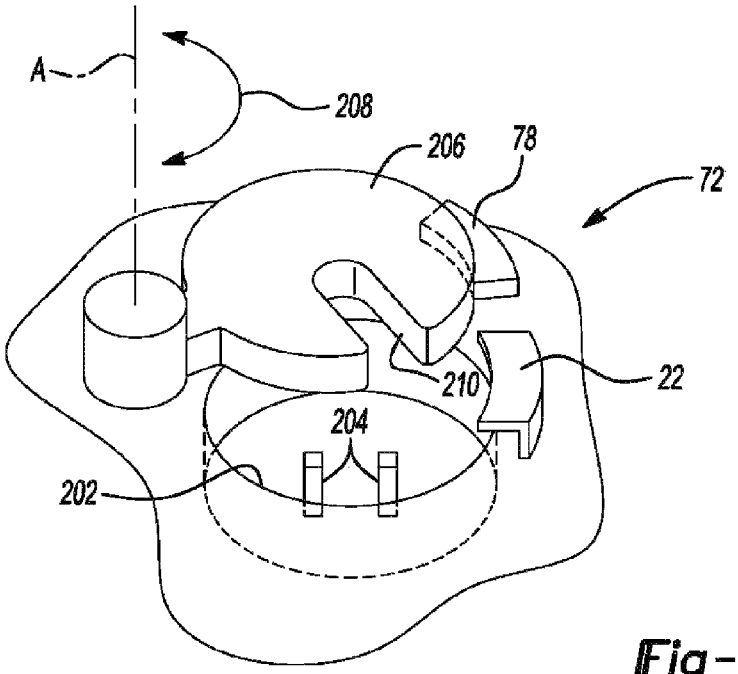
FIG. 7 is a perspective view of a further embodiment of the outlet cover.

The embodiment depicted in FIG. 7 is similar to the embodiment depicted in FIGS. 5 and 6, with the addition of a latch feature that may provisionally secure the door 205 in the closed position. As shown, a tab 220 may extend from the door 206, and a latch 222 may extend from the head 14'. When the door 206 is moved from the opened position (as shown in FIG. 7) to the closed position, the tab 220 may be positioned below the latch 222. In this condition, an upward facing surface of the tab 220 may contact a lower facing surface of the latch 222. The friction between the two contacting surfaces may provisionally secure the door 206 in the closed position.

In the disclosed embodiment, the notch 210 may be superposed above the recess 202 when the door 206 is in the closed position. Thus, the door 206 may not completely cover the recess 202. In alternative embodiments, a door may be implemented to completely cover the recess.

Figure 8:
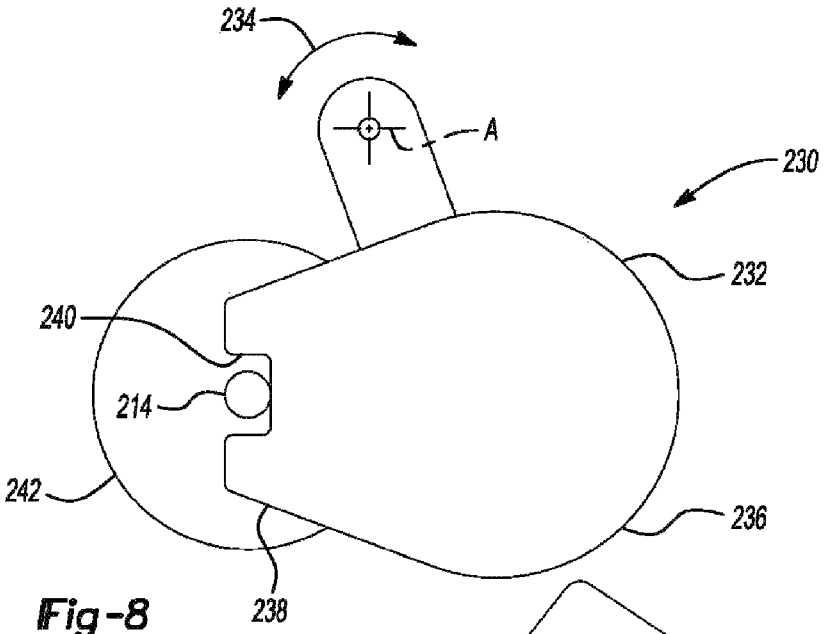
FIG. 8 is a plan view of a still further embodiment of the outlet cover.

With reference to the example onboard power outlet 230 depicted in FIG. 8, the door 232 may be mounted on the cover for pivot action (arrow 234) about an axis A. The door 232 may be shaped to include a covering portion 236 and an extended portion 238 in which the notch 240 may be provided. As shown, the door 232 may be located at an intermediate position (between an opened position and a closed position), so that the power cord 214 of the power tool enters into the notch 240 and the door 232 retains the power plug 216 of the power tool 212 in the recess 242. The operator may pivot the door 232 (counter clockwise in FIG. 8) to the opened position to remove the power plug from the onboard power outlet 72. The operator may then pivot the door 232 (clockwise in FIG. 8) to the closed position in which the extended portion 238 (and thus the notch 240) clears the recess 242 and the covering portion 236 superposes above (and completely covers) the recess 242.

Figure 9:
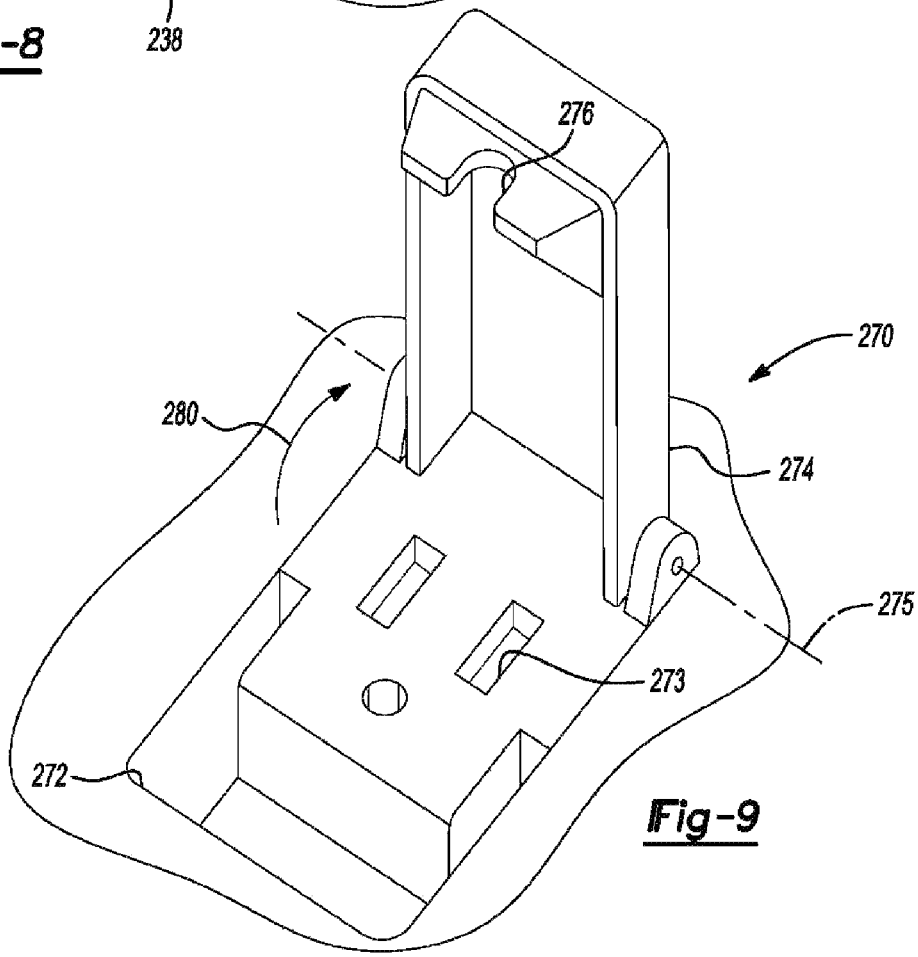
FIG. 9 is a perspective view of a further embodiment of the outlet cover.
Figure 10:
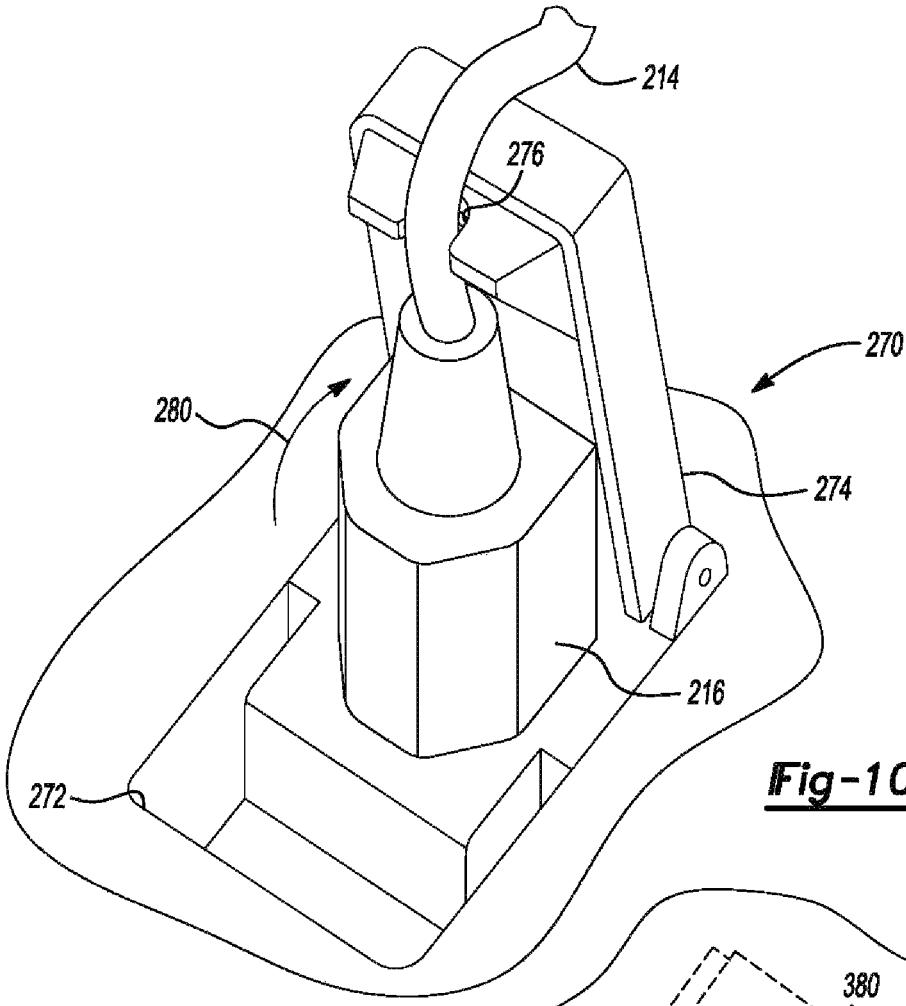
FIG. 10 is a perspective view of the outlet cover of FIG. 9 with a plug inserted in the outlet.

In the disclosed embodiments, the door may be mounted for pivot action about an axis that extends from the mounting surface. For example, in FIGS. 5 and 6, the axis A may be perpendicular to the mounting surface of the head 14'. In alternative embodiments, a door may be mounted for pivot action about an axis that is parallel to the mounting surface. With reference to the example onboard power outlet 270 depicted in FIGS. 9 and 10, the electrical contacts 273 of the onboard power outlet 270 may be flush with an opening of the recess 272. The door 274 may be mounted (via a hinge coupling, for example) on the cover for pivot action (in the direction of arrow 280) between an opened position and a closed position. As shown in FIG. 10, the door 274 may be located at an intermediate position (between the opened position and the closed position) so that the power cord 214 of the power tool enters into the notch 276 and the door 274 retains the power plug 216 of the power tool in the illustrated position. The operator may pivot the door 274 (clockwise in FIG. 10) to the opened position to remove the power plug 216 from the onboard power outlet 270. The operator may then pivot the door 274 (counter clockwise in FIG. 10) to the closed position in which the notch 276 enters into the recess 272. The notch 276 is on a face of the door 274 that faces the power outlet 273 when the door is in a closed position. In the closed position, the door 274 may superpose above (and completely cover) the recess 272. The outlet cover/door 274 pivots about an axis 275 that is parallel to a surface of the housing that surrounds the power outlet 273.

Figure 11:
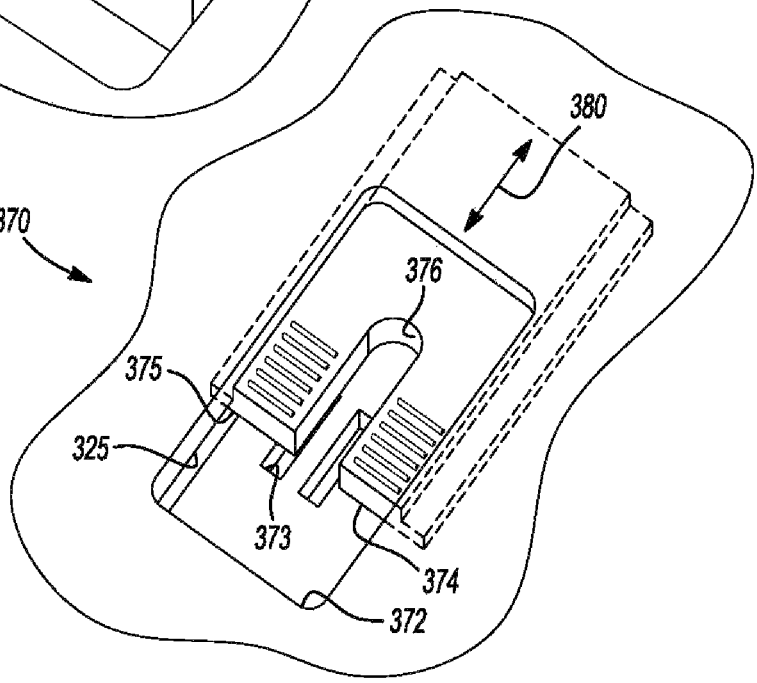
FIG. 11 is a perspective view of a further embodiment of the outlet cover.

In the disclosed embodiments, the door may be mounted on the vacuum for pivot action. In alternative embodiments, the door may be mounted on the vacuum for sliding action. With reference to the example onboard power outlet 370 depicted in FIG. 11, the door 374 may include outwardly extending flanges 375 (only one of which is shown that may be received in opposed guide grooves 325 (only one of which is shown) provided in the recess 372. During the sliding action (arrow 380) of the door 374 (between the opened and the closed positions), the guide grooves 325 may limit and guide the travel of the flanges 375 (and thus the door 374). The door may include a notch 376 that extends in the travel direction of the door 374. In this way, the door 374 may be slid to the closed position in which the notch receives a power cord of a power tool. It will be readily apparent that the recess 372 may include a pocket (not shown) for receiving the door 374 when moved toward the opened position.

In all of the disclosed embodiments, numerous and varied spring elements that are well known in this art may be suitable implemented to influence the door toward the closed position. In the example embodiment depicted in FIGS. 5 and 6, by way of example only, a spiral spring may be provided around the mounting pin connecting together the door 206 and the head 14'. The radial inner end of the spiral spring may be fixed to the mounting pin (or the door 206) and the radial outer end of the spiral spring may be fixed to the head 14'. An operator may pivot the door 206 toward the opened position to load the spiral spring. When the operator releases the door 206, the spiral spring may unload and influence the door 206 toward the closed position.

In all of the disclosed embodiments, numerous and varied features may be implemented to limit the movement of the door. For example, in the embodiment depicted in FIGS. 5 and 6, stop features may protrude from the surface of the head 14'. The stop features may be located on the head 14' at respective positions that abut against the door 206 in the opened and the closed positions.

What is claimed is:

1. A vacuum comprising:

a housing;

a vacuum source disposed in said housing;

a power outlet disposed on said housing;

an outlet cover disposed on said housing and movable to a first position for covering said power outlet and a second position for allowing a plug to be inserted in said power outlet, said outlet cover having a notch adapted to receive a cord connected to the plug, said outlet cover being operable for preventing the plug from being inadvertently pulled out of the power outlet; and wherein said outlet cover is slidably mounted to said housing.

2. A vacuum comprising:

a housing;

a vacuum source disposed in said housing;

a power outlet disposed on said housing; and an outlet cover disposed on said housing and pivotable to a first position for covering said power outlet and a second position for allowing a plug to be inserted in said power outlet, said outlet cover having a notch adapted to receive a cord connected to the plug, said outlet cover being operable for preventing the plug from being inadvertently pulled out of the power outlet, wherein an entirety of said outlet cover pivots together about a common axis in a plane parallel with a surface of said housing that surrounds said power outlet.

3. A vacuum comprising:

a housing;

a vacuum source disposed in said housing;

a power outlet disposed on said housing; and an outlet cover disposed on said housing and pivotable to a first position for covering said power outlet and a second position for allowing a plug to be inserted in said power outlet, said outlet cover having a notch adapted to receive a cord connected to the plug when in the second position, said outlet cover being operable for preventing the plug from being inadvertently pulled out of the power outlet, wherein said outlet cover pivots about an axis that is parallel to a surface of said housing that surrounds said power outlet, wherein said notch of said outlet cover is disposed on a face of said outlet cover that faces said power outlet when said outlet cover is in said first position.

* * * * *